United States Patent [19]

Harris et al.

[11] 4,441,721

[45] Apr. 10, 1984

[54] HIGH TEMPERATURE PACKER WITH LOW TEMPERATURE SETTING CAPABILITIES

[75] Inventors: Allen E. Harris; David D. Szarka, both of Duncan, Okla.

[73] Assignee: Halliburton Company, Duncan, Okla.

[21] Appl. No.: 375,417

[22] Filed: May 6, 1982

[51] Int. Cl.[3] ..... F16J 15/06; F16J 15/20; F16J 15/24

[52] U.S. Cl. ..... 277/26; 277/1; 277/117; 277/125; 277/DIG. 6

[58] Field of Search ..... 277/1, 9.5, 26, 116, 277/116.2, 116.4, 120–125, DIG. 6, 115, DIG. 10, 116.6, 116.8, 117

[56] References Cited

U.S. PATENT DOCUMENTS

| | | | |
|---|---|---|---|
| 2,140,710 | 12/1938 | Meisel | 277/1 X |
| 3,153,451 | 10/1964 | Chancellor et al. | 166/51 |
| 3,277,797 | 10/1966 | Tyree et al. | 277/26 X |
| 3,464,709 | 9/1969 | Furgason et al. | 277/123 X |
| 3,467,394 | 9/1969 | Bryant | 277/1 |
| 3,637,010 | 1/1972 | Maly et al. | 166/51 |
| 3,726,343 | 4/1973 | Davis, Jr. | 166/278 |
| 3,861,690 | 1/1975 | Englesson et al. | 277/26 |
| 4,061,344 | 12/1977 | Bradley et al. | 277/26 |
| 4,082,105 | 4/1978 | Allen | 277/26 X |
| 4,105,069 | 8/1978 | Baker | 166/51 |
| 4,258,926 | 3/1981 | Upton | 277/116.4 |
| 4,273,190 | 6/1981 | Baker et al. | 166/278 |
| 4,281,840 | 8/1981 | Harris | 277/117 |
| 4,296,806 | 10/1981 | Taylor et al. | 166/120 |

FOREIGN PATENT DOCUMENTS

| | | | |
|---|---|---|---|
| 412455 | 4/1925 | Fed. Rep. of Germany | 277/125 |
| 2412698 | 9/1975 | Fed. Rep. of Germany | 277/124 |

*Primary Examiner*—Robert S. Ward
*Attorney, Agent, or Firm*—Joseph A. Walkowski; Thomas R. Weaver

[57] ABSTRACT

A packer element design for use in well bores that may be at a relatively low initial temperature and be subsequently heated to much higher temperatures. High temperature packing material of asbestos fibers impregnated with Inconel wire is employed in packer rings of frusto-conical shape which face on a center packer ring of triangular cross-section formed of the same material. Low melting point thermoplastic wafers of frusto-conical shape are interspersed at least between adjacent frusto-conical packer rings. These thermoplastic wafers soften at a relatively low well bore temperature and help to initiate a seal when squeezed between the high temperature rings as the packer is set. As the well bore temperature increases, the low melting point thermoplastic liquifies and is squeezed out from between the high temperature packer segments, which then take over the sealing function.

19 Claims, 4 Drawing Figures

HIGH TEMPERATURE PACKER WITH LOW TEMPERATURE SETTING CAPABILITIES

BACKGROUND OF THE INVENTION

The invention relates to packers for use in well bores which are to be subjected to high temperatures. During a multiple-zone gravel packing operation, it is common practice to run a liner string into a cased hole in order to isolate the various zones from one another through use of packers placed between the zones. Such a gravel packing operation and the apparatus therefor is described in U.S. Pat. No. 4,273,190 to E. E. Baker et al, assigned to Halliburton Company and incorporated herein by reference. Inflatable packers, such as are disclosed in the aforesaid patent, are usually employed to isolate the zones from one another and from the remainder of the well bore. However, in certain geological formations, particularly as petroleum wells are drilled to even greater depths, the temperatures exceed those below which an inflatable packer may be employed. This is due to the inability of an inflatable packer employing an elastomeric bladder to withstand high temperatures without leakage past the packer or breakdown of the elastomeric packer components. Similarly, a compression-type elastomeric element packer will not function as these elements will fail under high temperatures. Furthermore, as steam injection becomes more prevalent for enhanced recovery operations in petroleum wells, elastomers will not perform adequately under the temperatures generated by the injection process. The use of non-elastomeric packer elements in known packers presents a problem in initiating the seal of the packer, as non-elastomeric elements generally tend to seal only at higher temperatures, which presents a problem in wells where the initial temperature may be only 150° F. at the packer location, such as in a well in which steam injection may be employed after the liner string is in place.

For example, the packer element disclosed in U.S. Pat. No. 4,281,840 to Harris, assigned to Halliburton Company, comprises packer segments formed of asbestos fibers impregnated with a thermoplastic such as polytetrafluoroethylene (Teflon) and interwoven with Inconel wire. The Inconel wire/asbestos fiber weave provides some resilience to the packer element at high temperatures, while the thermoplastic bridges between the asbestos fiber and Inconel wire, preventing steam or fluid migration through the packer element. However, at low (ambient) temperatures encountered in most non-geothermal wells, this bridging does not take place, and a defective seal results.

Similar problems attend the use of a packer element as disclosed in U.S. Pat. No. 4,258,926 to Upton, which employs particles of asbestos fiber mixed with mica particles, this mixture being confined by a mesh enclosure. This mix is compressed when the packer is set, and is "cured" as the well bore temperature is raised. Again, there is no adequate low temperature seal, as the gaps in the packer element "mix" will not be eliminated until the well bore temperature is substantially raised.

The problems associated with the non-elastomeric packer elements disclosed above were sought to be solved by use of both elastomeric and non-elastomeric packer segments in U.S. Pat. No. 4,296,806 to Taylor et al. A number of different packer elements are disclosed, the general design being a center elastomeric packer element of generally trapezoidal cross-section, with wire mesh-reinforced end elements of various materials, both elastomeric and non-elastomeric. The elastomeric material, and particularly the center ring, provides an initial low temperature seal, and a high temperature seal is sought by the use of a (generally) higher temperature material in the end segments, interwoven with the wire mesh. However, the disclosure indicates that the center segment may liquify at high (unspecified) temperatures, and goes into great detail regarding the role that the wire mesh and backup rings play in preventing extrusion of the elastomers with resultant loss of the seal. Such a design is obviously unreliable for a permanent installation.

SUMMARY OF THE INVENTION

In contrast to the prior art, the present invention comprises a packer element design capable of setting and sealing in a low temperature well bore, and maintaining the initial seal as the well bore temperature is raised to a high temperature, as by steam injection. The packer element comprises two types of segments, the high temperature segments being fabricated of asbestos fiber impregnated with an intermediate hard thermoplastic element such as polytetrafluoroethylene (Teflon), interwoven with Inconel wire. The low temperature segments are formed of a low melting point thermoplastic material such as ethylene vinyl acetate. The preferred configurations of the high temperature segments are as disclosed in the previously referenced U.S. Pat. No. 4,281,840 to Harris, being a center segment of substantially triangular configuration and multiple end segments of frusto-conical shape, the end segments facing the center segment. The low temperature segments are preferably shaped as frusto-conical wafers and are placed between adjacent high temperature segments, at least between adjacent frusto-conical high temperature segments.

As a packer employing the packer element of the present invention is set at a low temperature, the low melting point thermoplastic softens somewhat and creates a seal between the packer mandrel and the well bore casing, when the high temperature segments are ineffective to create a seal. As the well bore temperature is raised, as during steam injection, the thermoplastic initially melts and will fill any gaps between the high temperature elements, maintaining the seal as the high temperature segments soften and become more pliable. As the temperature further increases, the thermoplastic liquifies and is squeezed out from between the high temperature segments as they in turn maintain the seal by themselves at the high operating temperature.

Thus it may be appreciated that the packer element of the present invention incorporates the advantages of elastomeric materials to effect a low temperature seal and those of non-elastomeric materials to maintain such a seal at sustained high operating temperatures without falling prey to the inherent disadvantages of elastomers at high temperatures and non-elastomeric elements at low temperatures, such as is common in the prior art.

BRIEF DESCRIPTION OF THE DRAWINGS

The packer element of the present invention will be more easily understood by reference to the detailed description of the preferred embodiment set forth hereafter, taken in conjunction with the accompanying drawings, wherein.

DETAILED DESCRIPTION OF A PREFERRED EMBODIMENT OF THE PRESENT INVENTION

Figure 1:
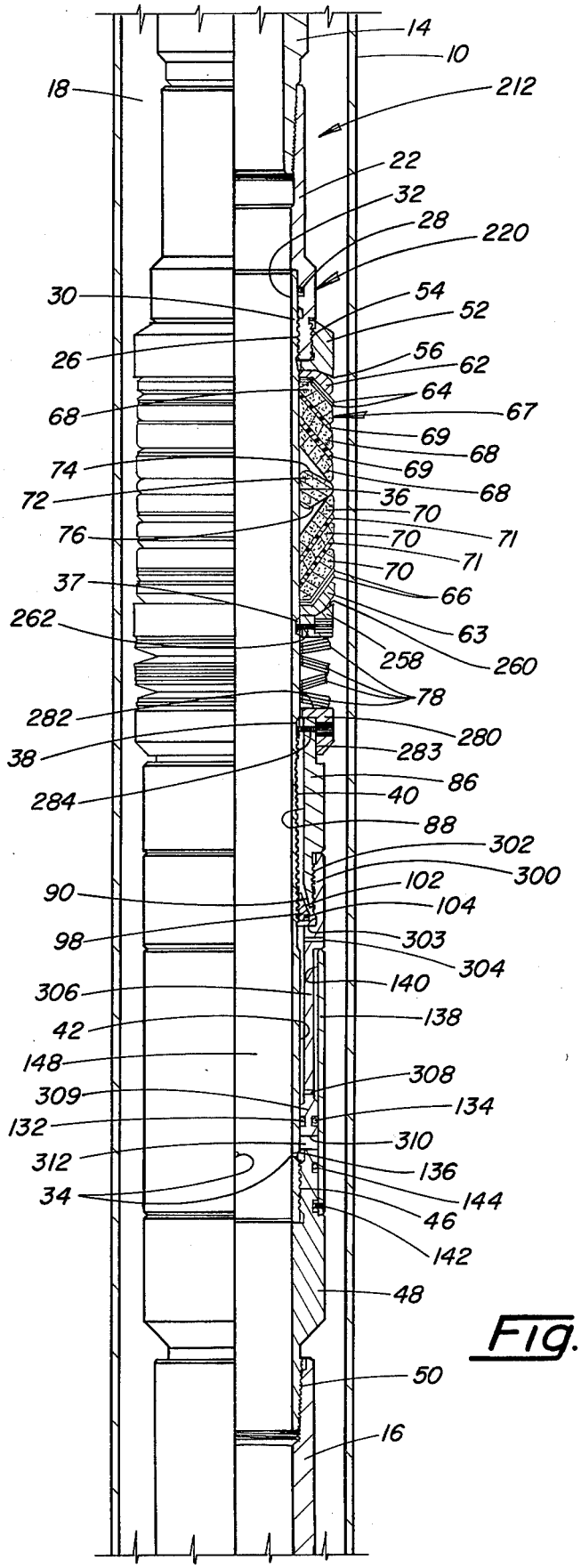
FIG. 1 illustrates a vertical half-section elevation of the packer element of the present invention in an unset mode, suspended in a well bore casing on a packer which is part of a liner assembly.
Figure 2:
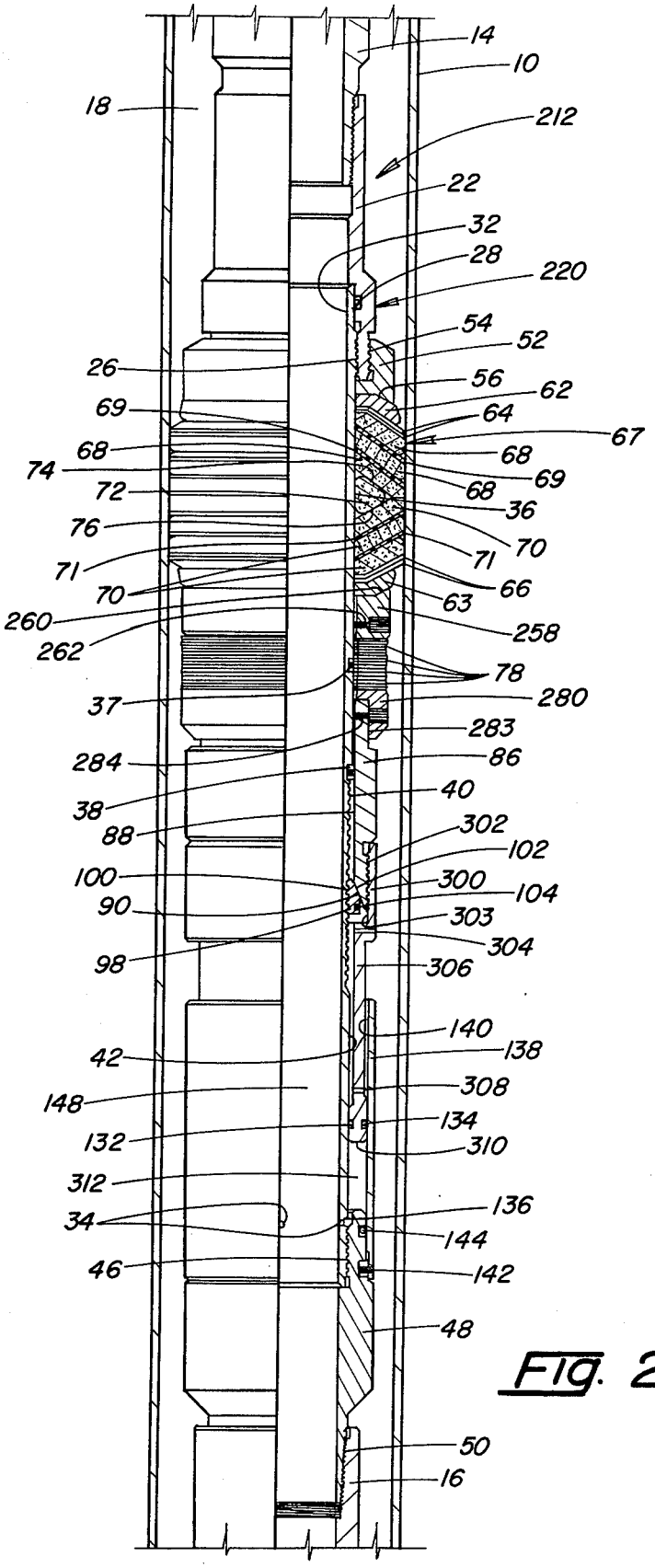
FIG. 2 depicts the packer element of FIG. 1 making an initial seal with the casing as the packer is set.

Referring to FIGS. 1 and 2 of the drawings, a preferred embodiment of the packer of the present invention will be described hereafter. Casing 10 surrounds packer 220, which is suspended therein as a part of liner assembly 212. Liner assembly 212 may include other packers such as packer 220, as well as gravel collars and other tools associated with gravel packing, such as are known in the art and disclosed in the previously referenced and incorporated U.S. Pat. No. 4,273,190. However, immediately above and below packer 220 are placed sections of liner pipe 14 and 16 respectively.

Packer 220 is attached to liner pipe 14 at connector 22 by threaded connection 24. Connector 22 surrounds the upper end of packer mandrel 30, and is threaded thereto at 26, a seal being effected therebetween at 28 by an O-ring backed at either side by backup seals. Packer mandrel 30 possesses an inner bore wall 32 of substantially uniform diameter throughout its axial extent. Bore wall 32 is pierced near its lower extent by radially spaced packer actuation ports 34, the purpose of which will be explained hereafter with respect to the operation of packer 20.

Below threaded connection 26, the exterior of packer mandrel 30 is of a substantially uniform diameter 36 having an annular recess 37 cut therein. Below diameter 36, there is a short area of reduced diameter 38 which is followed by an extended area of axially upward-facing ratchet teeth 40. Below ratchet teeth 40, the exterior of mandrel 30 increases to diameter 42. Packer mandrel 30, adjacent packer actuation port 34, is threaded at 46 to nipple 48, which in turn is threaded at 50 to blank liner pipe 16.

Referring again to the upper end of packer 220, upper anchor shoe 52 is threaded to the exterior of connector 22 at 54. Upper packer shoe 52 possesses a radially outward-extending lower face 56, the outer extent of which extends slightly downward. Below and facing upper packer shoe 52 is lower sliding shoe 258, which possesses a radially outward-extending upper face 260, the outer extent of which extends slightly upward. Lower sliding shoe 258 is slidably disposed on packer mandrel 30, but is held in the position shown in FIG. 1 as the packer 220 is run in the well by a plurality of radially spaced shear pins 262, the inner end thereof being received in annular recess 37. Abutting upper anchor and lower sliding shoes 52 and 58, respectively, are upper and lower back-up shoes 62 and 63, respectively. Upper back-up shoe 62 faces downward, while lower back-up shoe 63 faces upward. Abutting upper back-up shoe 62 is a pair of nested radially slotted supports, or cups 64. The radial slots of each cup 64 are misaligned with those of the adjacent cup 64. In a similar manner, a pair of nested radially slotted supports or cups 66 abuts lower back-up shoe 63, the radial slots in the nested cups 66 being misaligned.

Below and abutting lower sliding shoe 258, and surrounding packer mandrel 30, are a plurality of Belleville springs 78. Below Belleville springs 78 is lower anchor shoe 280, having radially flat upper face 282. Lower anchor shoe 80 overlaps and surrounds latch nipple 86 at 283. Latch nipple 283 possesses an inner diameter substantially greater than the outer radial extent of ratchet teeth 40, which it envelops. At the lower axial extent of latch nipple 86 is located downwardly radially divergent face 90. Latch nipple 86 is threaded to annular piston 300 at 302. Latch nipple 86 and hence annular piston 300 are fixed in place while packer 220 is run into the well by a plurality of shear pins 284, which extend into reduced diameter area 38 on mandrel 30. Annular piston 300 possesses an undercut at 303. An annular cavity of substantially triangular cross-section is created by undercut 303, radially divergent face 90 of latch nipple 86, and ratchet teeth 40. In the aforesaid annular cavity is disposed latching dog 98, which comprises a plurality of arcuate segments. The inner edge of these arcuate segments possesses downward-facing ratchet teeth 100 which mate with upward-facing ratchet teeth 40 on packer mandrel 30. The forward faces 102 of the segments of latching dog 98 are radially inclined at substantially the same angle as radially divergent face 90 of latch nipple 86. The segments of latching dog 98 are held against ratchet teeth 40 of packer mandrel 30 by O-ring 104. The lower face (unnumbered) of latching dog 98 is radially flat.

Annular piston 300 is slidably disposed about packer mandrel 30. A plurality of pressure relief ports 304 extend from the inner surface of the forward portion of annular piston 300 to the outer surface, which is on the outside of packer 220. Similarly, a plurality of pressure relief ports 308 extend from the inner surface to the outer surface of piston 300 near its lower end. The trailing portion 309 of piston 300 is of greater wall thickness and smaller inner and outer diameter than the forward extent thereof, riding in sealing engagement with surface 42 of packer mandrel 30 and also with outer sleeve 138, which surrounds piston 300 throughout a portion of the piston's axial extent. A seal is effected with packer mandrel 30 by O-ring and back-up seals 134. The trailing surface 310 of piston 300 is radially flat.

Fluid passage 136 extends between an annular chamber defined by trailing surface 310, the inner surface 140 of outer sleeve 138, packer mandrel 30, the leading surface of nipple 48, and packer actuation port 34.

A seal is effected between nipple 48 and outer sleeve 138 by O-ring and back-up seals 144, outer sleeve 138 being fixed to nipple 48 by set screws 142.

Packer element 67 is disposed about packer mandrel 30 between upper cups 64 and lower cups 66. Packer element 67 comprises both high termperature and low temperature packer segments.

High temperature packer segments are made of asbestos fiber impregnated with an intermediate hard thermoplastic such as Teflon, interwoven with Inconel wire. The resulting fabric is laid up in a preform, and subsequently pressure molded to form the desired segment shape. End packer rings 68 and 70 are of frusto-conical cross-section with substantially parallel radially inclined side faces. Packer rings 68 face axially downward on packer mandrel 30, and packer rings 70 face in an axially upward direction. Center packer ring 72, which is abutted on either side by end packer rings 68 and 70, is preferably of substantially triangular cross-section with side faces 74 and 76 convergently radially inclined at substantially equal angles. Packer rings 68, 70 and 72 are of substantially the same outer diameter in their uncompressed state. The angle of radial inclination of the side faces of packer rings 68 and 70 is greater than that of side faces 74 and 76 of center packer ring 72.

Low temperature packer segments 69 and 71 comprise frusto-conically shaped wafers of a low melting point thermoplastic material. Segments 69 and 71 are preferably disposed at least between adjacent frusto-conical high temperature packer segments 68 and 70, respectively. A suitable and preferred material for low temperature packer segments 69 and 71 is ethylene vinyl acetate. Other materials which may be employed are polyethylene, polypropylene, and polystyrene.

OPERATION OF THE PREFERRED EMBODIMENT OF THE PRESENT INVENTION

Referring to drawing FIGS. 1 through 4, the operation of the packer element 67 of the present invention is described hereafter in detail.

In operation, packer 220 may be run at a relatively low temperature, for example, 150°–230° F., into the well casing 10 as a part of liner assembly 212, which is secured in place. An isolation gravel packer as disclosed in U.S. Pat. No. 4,273,190 is placed across ports 34 and tubing pressure is applied therethrough against trailing surface 310 of annular piston 300. The use of the isolation gravel packer for pressuring port 34 is by way of example and not limitation. Any tool may be employed which allows localization of tubing pressure at port 34. Such tools are disclosed in U.S. Pat. Nos. 3,153,451; 3,637,010, 3,726,343 and 4,105,069. As annular piston 300 moves axially upward, latch nipple 86 is forced in the same direction, and shear pins 284 are sheared. Lower anchor shoe 280 then acts upon Belleville springs 78, compressing them fully. After springs 78 are compressed, the continued upward movement of lower anchor shoe 280 shears shear pins 262, releasing lower sliding shoe 258, which in turn moves upward, compressing packer segments 68, 69, 70, 71 and 72 against upper anchor shoe 52, forcing the packer element 67 radially outward against the wall of casing 10.

The movement of annular piston 300 and latch nipple 86 in an axially upward direction carries latching dogs 98 in the same direction, due to the contact of latching dogs 98 with the radially flat surface immediately below undercut 302 on annular piston 300. The downward-facing ratchet teeth 100 on latching dogs 98 ride over the upward-facing ratchet teeth 40 on packer mandrel 30 with minimal resistance.

At this point, packer segments 68, 69, 70, 71 and 72 are compressed, as are Belleville springs 78. When tubing pressure is released, latch nipple 86 will tend to ride back down to its initial position due principally to the force exerted by the compressed Belleville springs 78. This downward movement will be halted after a very brief travel by the contact of radially divergent face 90 with the forward faces 102 of latching dogs 98, which will force dogs 98 radially inward, locking them against mandrel 30 by the interaction of ratchet teeth 100 with ratchet teeth 40. Thus, packer 220 is locked in a set position without the continued maintenance of tubing pressure, and packer segments 68, 70 and 72, which are of non-elastomeric materials, are maintained in compression by the continued force of compressed Belleville springs 78. While the casing is at a relatively low temperature, such as prior to a steam injection operation, low temperature packer segments 69 and 71 seal against the casing 10 and are held in place by high temperature segments 68, 70 and 72. The triangular center packer ring 72 causes outward rotational movement of packer rings 68, 69, 70 and 71, as sides 74 and 76 of center packer ring 72 are oriented at a lesser angle than are the frusto-conical packer rings when setting pressure is applied, enhancing the seal against casing 10 and providing a torsional as well as a longitudinal counterforce due to the resiliency imparted to segments 68, 70 and 72 by the Inconel wire/asbestos fiber weave. This resiliency is maintained even as well bore temperatures are increased, unlike elastomeric packer elements which tend to relax at higher temperatures. The stacking of the frusco-conical high temperature packer rings in an opposing symmetrical manner with respect to the center packer ring results in an effective seal against differential pressure in either direction, as the outer edges of the downward-facing frusto-conical packer rings will be forced into tighter sealing engagement in response to greater differential pressure below the bridge plug, while greater downward-acting differential pressure will more tightly seal the upward-facing rings. The sealing effect in both of these instances is due to the action of the pressure upon the center packer ring, which radially spreads the set of the rings facing the direction of the applied pressure. The metal cups 64 and 66 at each end of the packer element lend structural support to the packer element.

Figure 3:
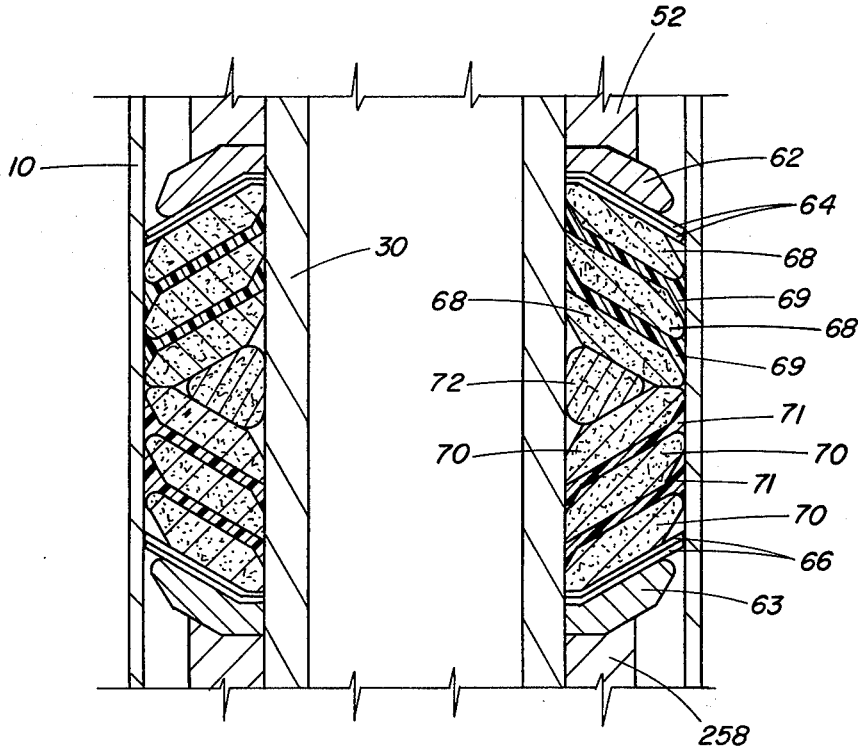
FIG. 3 is an enlarged vertical full section of the packer element of the present invention shown on a schematic packer mandrel, after the well bore temperature has been increased to substantially near the melting point of the thermoplastic material of the element.
Figure 4:
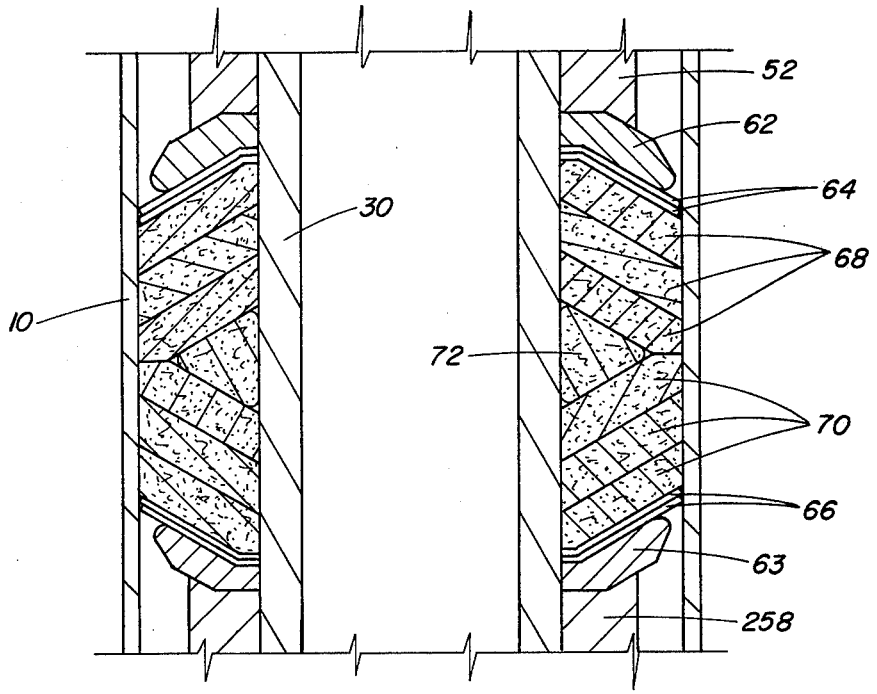
FIG. 4 is an enlarged vertical full section similar to FIG. 3, after the melting point of the thermoplastic material of the element has been exceeded, and the thermoplastic material has been squeezed out from between the high temperature packer segments, which deform to create a high temperature seal.

As the temperature of the well bore increases, low temperature packer segments 69 and 71 soften and are "squeezed," as shown in FIG. 3, to the point where they fill the gaps between the high temperature packer segments 68, 70 and 72, the packer seal in this situation being partly provided by the softened low temperature segments and partially by the high temperature segments, which have made firmer contact with the casing wall, the intermediate hard thermoplastic filler in these segments preventing migration of steam or fluid past the packer element. As the well bore temperature is raised to its final level, for example 700° or more, the Belleville springs 78 maintaining compression on packer element 67 will literally squeeze out the now liquified low temperature segments 69 and 71, and further compress high temperature segments 68, 70 and 72 as shown in FIG. 4 so that the high temperature segments now provide the entire seal effected by the packer element 67. Center packer ring 72 provides a positive seal against mandrel 30, due to the radial inward loading of high temperature end rings 68 and 70. As noted previously, the opposing sets of end rings 68 and 70 resist pressure pulses or surges in either direction. A packer element of this construction will hold at least 5,000 PSI differential pressure at 700° F. with a positive seal for an indefinite period of time.

While the packer element herein disclosed has been shown mounted on a packer, it must be noted that the packer element design is equally suitable for use in a bridge plug or any other sort of pack-off device, and that the packer element design is effective in open borehole as well as in casing.

Certain modifications to the invention as disclosed will be readily apparent to one of ordinary skill in the art. For example, low temperature packer segments may also be used adjacent the center high temperature ring. Other low melting point thermoplastic materials may be employed for the low temperature packer segments. A high temperature center ring of trapezoidal shape may be employed if a wider base seal is desired. A triangular cross-section center ring with the base on the outer diameter of the segment could be used, with the frusto-conical end rings and wafers facing away from the center ring. These and other additions, deletions, substitutions or modifications may be made without departing from the spirit and scope of the invention, as defined by the claims.

We claim:

1. In a pack-off device of the type including means to longitudinally compress a packer element associated with said device, a packer element comprising:

at least one low temperature packing segment adapted to maintain shape and substantial resiliency up to a predetermined temperature and to lose shape and resiliency at temperatures thereabove; and a plurality of high temperature packing segments adapted to maintain shape and substantial resiliency at temperatures including and above said predetermined temperature, said at least one low temperature packing segment being disposed between at least two of said plurality of said high temperature packing segments.

2. The packer element of claim 1, wherein said plurality of high temperature packing segments comprises at least three, and said at least one low temperature packing segment comprises at least two.

3. The packer element of claim 2, wherein said at least three high temperature packing segments comprises one center packer ring and at least two end packer rings arranged adjacent said center packer ring; and said at least two low temperature packing segments comprise wafer-like rings disposed between high temperature packing segments.

4. The packer element of claim 3, wherein said wafer-like rings comprise a low melting point thermoplastic material.

5. The packer element of claim 4, wherein said low melting point thermoplastic material comprises ethylene vinyl acetate.

6. The packer element of claim 4, wherein said low melting point thermoplastic material comprises polyethylene.

7. The packer element of claim 4, wherein said low melting point thermoplastic material comprises polypropylene.

8. The packer element of claim 4, wherein said low melting point thermoplastic material comprises polystyrene.

9. The packer element of claim 4, wherein said high temperature packing segments comprise asbestos impregnated with an intermediate thermoplastic and interwoven with Inconel wire.

10. The packer element of claim 9, wherein said intermediate hard thermoplastic is polytetrafluoroethylene.

11. The packer element of claim 3, wherein said center packer ring and said at least two end packer rings comprise asbestos impregnated with an intermediate hard thermoplastic and interwoven with Inconel wire; and said wafer-like rings comprise a low melting point thermoplastic.

12. The packer element of claim 11, wherein said intermediate hard thermoplastic comprises polytetrafluoroethylene and said low melting point thermoplastic comprises ethylene vinyl acetate.

13. The packer element of claim 12, wherein said center packer ring has two oblique side faces;

said at least two end packer rings are of frusto-conical configuration with substantially parallel side faces; and said at least two wafer-like rings are of frusto-conical configuration.

14. The packer element of claim 13, wherein said end packer rings have an angle of radial inclination greater than the angle of radial inclination of said center packer ring side faces.

15. The packer element of claim 14, wherein said at least two end packer rings are arranged on opposite sides of said center packer ring, the at least one end ring on one side of said center packer ring facing said at least one end ring on the other side of said center packer ring; and said at least two wafer-like rings are disposed in a facing orientation.

16. The packer element of claim 2, wherein said plurality of high temperature packing segments comprises a center packer ring having two oblique side faces, a first plurality of frusto-conical packer rings having substantially parallel oblique side faces and arranged adjacent to and facing said center packer ring;

a second plurality of frusto-conical packer rings having substantially parallel oblique side faces and arranged adjacent to and facing said center packer ring; and said at least one low temperature packing segment comprises a plurality of wafer-like rings of frusto-conical configuration disposed at least between adjacent frusto-conical packer rings.

17. The packer element of claim 16, wherein said high temperature packing segments comprise asbestos impregnated with polytetrafluoroethylene and interwoven with Inconel wire; and said low temperature packing segments comprise ethylene vinyl acetate.

18. A packer element for use on a mandrel of a pack-off device of the type which effects a seal across a well bore through longitudinal compression and radial expansion of said element, comprising:

a center packer ring comprising asbestos impregnated with an intermediate hard thermoplastic and interwoven with Inconel wire, said center packer ring having two oblique side faces;

a first and second plurality of frusto-conical packer rings, each plurality adjacent one side of said center packer ring, all of said frusto-conical packer rings comprising asbestos impregnated with an intermediate hard thermoplastic and interwoven with Inconel wire; and a plurality of frusto-conical wafers disposed at least between adjacent frusto-conical packer rings, said wafers comprising a low melting point thermoplastic.

19. The packer element of claim 18, wherein said intermediate hard thermoplastic comprises polytetrafluoroethylene, and said low melting point thermoplastic comprises ethylene vinyl acetate.

* * * * *